US010533505B1

(12) United States Patent
Choi

(10) Patent No.: US 10,533,505 B1
(45) Date of Patent: Jan. 14, 2020

(54) VARIABLE COMPRESSION RATIO APPARATUS

(71) Applicants: Hyundai Motor Company, Seoul (KR); Kia Motors Corporation, Seoul (KR)

(72) Inventor: Myungsik Choi, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/185,995

(22) Filed: Nov. 9, 2018

(30) Foreign Application Priority Data

Aug. 3, 2018 (KR) ..... 10-2018-0090954

(51) Int. Cl.
*F02D 15/02* (2006.01)
*F02B 75/04* (2006.01)

(52) U.S. Cl.
CPC ..... *F02D 15/02* (2013.01); *F02B 75/045* (2013.01)

(58) Field of Classification Search
CPC ..... F02D 15/02; F02D 15/00; F02B 75/045; F02B 75/044; F02B 75/048
See application file for complete search history.

(56) References Cited

U.S. PATENT DOCUMENTS 7,469,663 B1 * 12/2008 Berger ..... F02B 75/045 123/48 B
2012/0000444 A1 1/2012 Yang et al.
2017/0002732 A1 * 1/2017 Paul ..... F02B 75/045
2017/0284455 A1 * 10/2017 Kim ..... F02B 75/045

FOREIGN PATENT DOCUMENTS

JP H 02-99729 A 4/1990
JP H08-9386 Y2 3/1996
JP 2006-177270 A 7/2006
KR 10-1338461 B1 12/2013

* cited by examiner

*Primary Examiner* — Jacob M Amick
(74) *Attorney, Agent, or Firm* — Mintz Levin Cohn Ferris Glovsky and Popeo, P.C.; Peter F. Corless

(57) ABSTRACT

A variable compression ratio apparatus is provided. The apparatus includes a connecting rod, a small end forming an aperture to be rotatably connected with a piston pin moving together with a piston, a larger end rotatably connected with a crankpin eccentrically arranged with respect to the crankshaft. An acting oil passage allows hydraulic pressure to be supplied from the larger end to the small end. An eccentric cam is concentrically arranged and rotatably disposed in the aperture of the small end. The piston pin is inserted thereinto and rotatably connected therewith. A latching pin is disposed in the small end to generate a reciprocal rectilinear motion in a direction of a rotation axis of the small end and selectively latches the small end with the eccentric cam in one of at least two relative positions between the small end and the eccentric cam by hydraulic pressure.

13 Claims, 8 Drawing Sheets

VARIABLE COMPRESSION RATIO APPARATUS

CROSS-REFERENCE TO RELATED APPLICATION

This application claims priority to and the benefit of Korean Patent Application No. 10-2018-0090954 filed on Aug. 3, 2018, the entire contents of which are incorporated herein by reference.

BACKGROUND

(a) Field of the Invention

The present invention relates to a variable compression ratio apparatus, and more particularly, to a variable compression ratio apparatus in which a compression ratio of a mixture in a combustion chamber is varied according to an operational state of an engine.

(b) Description of the Related Art

Generally, heat efficiency of a compression ignition engine is increased when a compression ratio is high, and in a spark ignition engine, when ignition timing is advanced to a particular level, heat efficiency is increased. However, when ignition timing of a spark ignition engine is advanced at a high compression ratio, abnormal combustion occurs to damage the engine. Thus, there is a limitation in advancing ignition timing and a corresponding degradation of output should be tolerated.

A variable compression ratio (VCR) apparatus is an apparatus for changing a compression ratio of a mixture according to an operational state of an engine. According to the VCR apparatus, a compression ratio of a mixture is increased in a low load condition to enhance mileage (or fuel efficiency), and the compression ratio of the mixture is decreased in a high load condition to prevent generation of knocking and enhance engine output.

The related art VCR apparatus implements a change in a compression ratio by changing a length of a connecting rod that connects a piston and a crankshaft. In the VCR apparatus, the part that connects the piston and the crankshaft includes several links, to allow the combustion pressure to be directly transmitted to the links. Thus, durability of the links weakens. Various experimentation results with respect to the related art VCR apparatus have revealed that operation reliability is high when a distance between a crankpin and a piston pin is changed using an eccentric cam. Meanwhile, when hydraulic pressure is used to rotate an eccentric cam, an amount of rotation and an amount of hydraulic outflow of the eccentric cam of each cylinder are different, resulting in a compression ratio of each cylinder that is not uniform and a time during which a compression ratio is changed varies according to engine operational conditions. Further, control of latching an eccentric cam may become more difficult.

The above information disclosed in this section is merely for enhancement of understanding of the background of the invention and therefore it may contain information that does not form the prior art that is already known in this country to a person of ordinary skill in the art.

SUMMARY

The present invention provides a variable compression ratio apparatus having advantages of changing a compression ratio of a mixture by installing an eccentric cam in a small end portion of a connecting rod and selectively latching the eccentric cam in positions that are different from each other.

In addition, the present invention provides a variable compression ratio apparatus having further advantages of preventing interference by rotational inertia when latching the eccentric cam and reducing cost since a latching pin is provided having a simplified composition to be moved in a direction which is arranged in parallel with a crankshaft. The variable compression ratio apparatus according to an exemplary embodiment of the present invention may be a variable compression ratio (VCR) apparatus which is installed within an engine rotating a crankshaft upon receiving combustion power of a fuel mixture from a piston and may be configured to change a compression ratio of the mixture according to a driving condition of the engine.

Particularly, the VCR apparatus may include: a connecting rod at which a small end that forms an aperture having a circular shape to be rotatably connected with a piston pin moving together with the piston, a larger end rotatably connected with a crankpin eccentrically arranged with respect to the crankshaft, and an acting oil passage formed such that hydraulic pressure is supplied from the larger end to the small end, are formed; an eccentric cam concentrically arranged and rotatably disposed in the aperture of the small end and the piston pin may be eccentrically inserted thereinto and may be rotatably connected therewith; a latching pin disposed in the small end to generate a reciprocal rectilinear motion in a direction of an axis of rotation of the small end and operated to selectively latch the small end with the eccentric cam in one among at least two relative positions between the small end and the eccentric cam by hydraulic pressure being supplied to the small end through the acting oil passage; a first plate disposed to cover a first opened surface of the small end, in which the eccentric cam is inserted and seated, to move together with the eccentric cam and configured so that the piston pin is rotatably connected thereto and the latching pin for latching the small end with the eccentric cam may be selectively inserted thereinto; and a second plate disposed to cover a second opened surface of the small end, in which the eccentric cam is inserted and seated, to move together with the eccentric cam and the piston pin may be rotatably connected thereto and the latching pin for latching the small end with the eccentric cam may be selectively inserted thereinto.

The acting oil passages may include: a first oil passage extended from the larger end to the small end in a length direction of the connecting rod to receive hydraulic pressure transferred through the crankshaft and disposed to be proximate to the first plate; a second oil passage extended from the larger end to the small end in a length direction of the connecting rod to receive hydraulic pressure transferred through the crankshaft and disposed to be proximate to the second plate; and a communicating passage extended in a direction of an axis of rotation in the small end to communicate the first oil passage with the second oil passage, and the latching pin may be disposed therein to move toward the first plate by hydraulic pressure supplied through the first oil passage and move toward the second plate by hydraulic pressure supplied through the second oil passage.

The latching pin may form a first land at a first end of the latching pin in a direction for generating a rectilinear motion and arranged with an exterior surface thereof facing an interior surface of the first plate; a second land at a second end of the latching pin in a direction for generating a rectilinear motion and arranged with an exterior surface thereof facing an interior surface of the second plate; and a spool shaft to be thinner than the first land and the second land and adapted to connect the first land and the second land.

The communicating passage may form: a first chamber that communicates with the first oil passage, formed to be longer than the first land in a direction for generating a rectilinear motion of the latching pin and to have a size that corresponds with the first land in a direction which is vertically arranged in a direction for generating a rectilinear motion of the latching pin at a first end side of the communicating passage to disposed the first land therein, and an exterior side thereof may be opened; a second chamber that communicates with the second oil passage, formed to be longer than the second land in a direction for generating a rectilinear motion of the latching pin and to have a size that corresponds with the second land in a direction which is vertically arranged in a direction for generating a rectilinear motion of the latching pin at a second end side of the communicating passage to dispose the second land therein, and an exterior side thereof may be opened; and a communicating aperture that provides communication between the first chamber and the second chamber to dispose the spool shaft therein and formed to have a size that corresponds with the spool shaft in a direction which is vertically arranged in a direction for generating a rectilinear motion of the latching pin.

A force for moving the latching pin toward the first plate may be generated as hydraulic pressure being transferred between an interior surface of the first land and the communicating aperture in the first chamber pushes an interior surface of the first land when hydraulic pressure transferring through the first oil passage is supplied to the first chamber. The latching pin may be moved such that the first land is inserted into a first latching groove when the first latching groove that is recessed from an interior surface of the first plate is positioned to correspond with the first chamber based on rotation of the eccentric cam while maintaining the force for moving the latching pin toward the first plate.

A low compression ratio condition of an engine may be achieved as top dead center of the piston is relatively low when the small end is latched to the eccentric cam by inserting the first land into the first latching groove. An operation of returning the latching pin into a state that the small end is not latched to the eccentric cam may be performed as hydraulic pressure transferred between an interior surface of the second land of the second chamber and the communicating aperture via the second oil passage pushes an interior surface of the second land in a state that the first land is inserted into the first latching groove.

A force for moving the latching pin toward the second plate may be generated as hydraulic pressure being transferred between an interior surface of the second land and the communicating aperture in the second chamber pushes an interior surface of the second land when hydraulic pressure transferring through the second oil passage is supplied to the second chamber. The latching pin may be to insert that the second land into the second latching groove when the second latching groove that is recessed from an interior surface of the second plate is positioned to correspond with the second chamber depending on rotation of the eccentric cam while maintaining the force for moving the latching pin toward the second plate.

A high compression ratio condition of an engine may be achieved as top dead center of the piston is relatively high when the small end is latched to the eccentric cam by inserting the second land into the second latching groove. An operation of returning the latching pin into a state that the small end is not latched to the eccentric cam may be performed as hydraulic pressure transferred between an interior surface of the first chamber and the communicating aperture via the first oil passage pushes an interior surface of the first land in a state that the second land is inserted into the second latching groove.

Either one among a low compression ratio condition of an engine by a relatively low top dead center of the piston and a high compression ratio condition of an engine by a relatively high top dead center of the piston may be achieved when the first land is inserted into a first latching groove that is recessed from an interior surface of the first plate based on rotation of the eccentric cam while maintaining a force to cause an interior surface of the first land to be pushed by hydraulic pressure transferred between an interior surface of the first land and the communicating aperture in the first chamber via the first oil passage.

The other one among a low compression ratio condition of an engine by a relatively low top dead center of the piston and a high compression ratio condition of an engine by a relatively high top dead center of the piston may be achieved when the second land is inserted into a second latching groove that is recessed from an interior surface of the second plate based on rotation of the eccentric cam while maintaining a force to cause an interior surface of the second land to be pushed by hydraulic pressure transferred between an interior surface of the second land and the communicating aperture in the second chamber via the second oil passage.

BRIEF DESCRIPTION OF THE DRAWINGS

The above and other aspects, features and advantages of the present disclosure will be more apparent from the following detailed description taken in conjunction with the accompanying drawings, in which.

DESCRIPTION OF SYMBOLS

Figure 1:
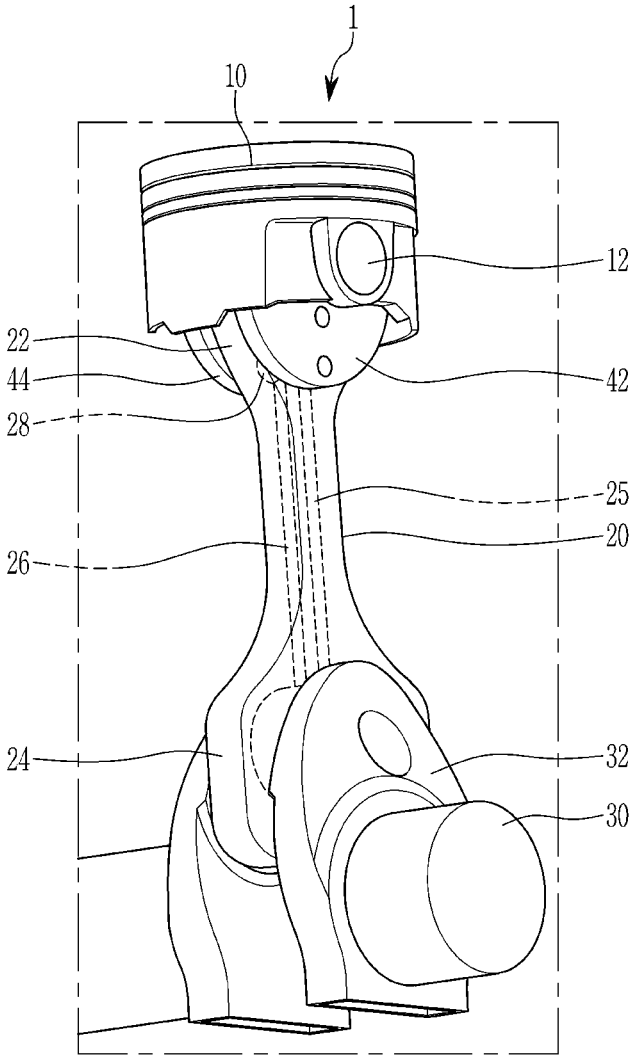
FIG. 1 is a perspective view of a variable compression ratio apparatus according to an exemplary embodiment of the present invention.

1: variable compression ratio apparatus
10: piston
12: piston pin
20: connecting rod
22: small end
24: big end
25: first oil passage
25*c*: first chamber
26: second oil passage
26*c*: second chamber
28: communicating passage

28*h*: communicating aperture
30: crankshaft
32: balance weight
34: crankpin
40: eccentric cam
42: first plate
42*g*: first latching groove
44: second plate
44*g*: second latching groove
46: fastening pin
50: latching pin
51: first land
52: second land
53: spool shaft

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

An exemplary embodiment of the present invention will hereinafter be described in detail with reference to the accompanying drawings.

Figure 2:
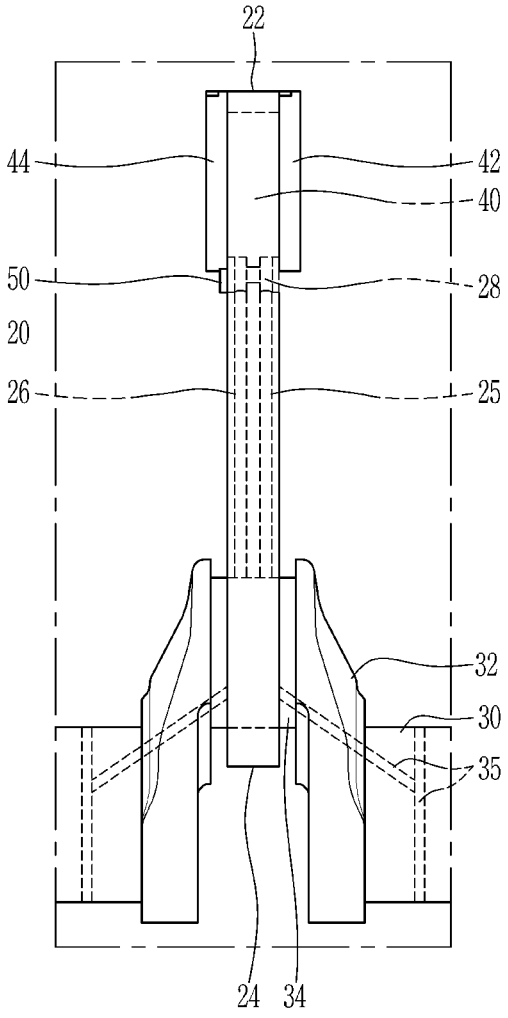
FIG. 2 is a drawing of a piston that is removed for showing a composition of a variable compression ratio apparatus according to an exemplary embodiment of the present invention.
Figure 3:
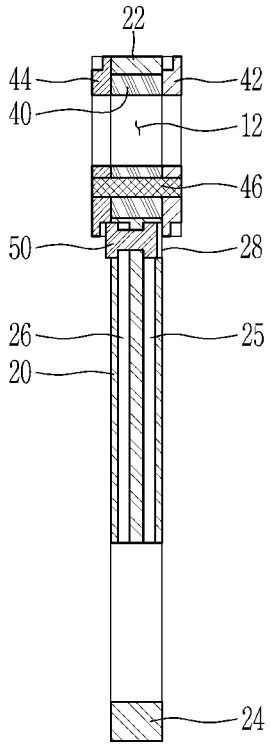
FIG. 3 is a cross-sectional view taken along a length direction of a connecting rod in FIG. 2 according to an exemplary embodiment of the present invention.

FIG. 1 is a perspective view of a variable compression ratio apparatus according to an exemplary embodiment of the present invention, FIG. 2 is a drawing of a piston that is removed for showing a composition of a variable compression ratio apparatus according to an exemplary embodiment of the present invention, and FIG. 3 is a cross-sectional view taken in a length direction of a connecting rod in FIG. 2.

FIGS. 1 to 3 illustrate a part of an engine for showing a composition of a variable compression ratio apparatus 1 according to an exemplary embodiment of the present invention. As shown in FIGS. 1 to 3, a variable compression ratio apparatus 1 according to an exemplary embodiment of the present invention is provided to an engine that rotates a crankshaft 30 upon receiving combustion power of a fuel mixture from a piston 10 to change a compression ratio of the mixture based on driving conditions of the engine.

In particular, the piston 10 generates a vertical movement within a cylinder (not shown), and a combustion chamber may be formed between the top of the piston 10 and the cylinder. In addition, the crankshaft 30 may be configured to receive combustion power from the piston 10, convert the combustion power into rotational force, and transfer the rotational force to a transmission (not shown). The crankshaft 30 may be installed in a crankcase (not shown) formed at a lower end of the cylinder. Additionally, a plurality of balance weights 32 may be coupled or formed in the crankshaft 30 to reduce vibrations generated by rotation. The basic composition and function of an engine are well known to a person of ordinary skill in the art.

The variable compression ratio apparatus 1 according to an exemplary embodiment of the present invention may include a connecting rod 20, an eccentric cam 40, and acting oil passages 25, 26, and 28. The connecting rod 20 may be configured to receive the combustion force from the piston 10 to transmit the received combustion force to the crankshaft 30. To transmit the combustion force, a first end of the connecting rod 20 may be rotatably connected to the piston 10 by a piston pin 12 and a second end of the connecting rod 20 may be rotatably connected to the crankshaft 30 and the balance weight 32 by a crankpin 34 which is eccentrically arranged with respect to the crankshaft 30. In general, a first end portion of the connecting rod 20 connected with the piston 10 is referred to as a small end 22, and a second end portion of the connecting rod 20 connected with the crankshaft 30 to have a radius of gyration that is greater than that of the a small end 22 is referred to as a larger end 24.

In addition, an aperture (e.g., a bore) bored in a direction of the axis of rotation may be formed at the small end 22. The aperture of the small end 22 may be formed in a circular shape to rotatably connect the small end 22 with the piston pin 12. Herein, it is well known to a person of ordinary skill in the art that the piston pin 12 generates a vertical movement together with the piston 10, and in this specification, a piston pin insertion aperture 12 in which the piston pin 12 may be inserted and positioned and the piston pin 12 will be represented by a same reference numeral. In this regard, an entire shape of the connecting rod 20 of the variable compression ratio apparatus 1 according to an exemplary embodiment of the present invention is similar to or the same as that of an ordinary connecting rod. Therefore, it is possible that a change of design is minimized in an ordinary engine even though the variable compression ratio apparatus is installed therein.

The eccentric cam 40 may be disposed at the small end 22 of the connecting rod 20 to be rotatably inserted into the aperture of the small end 22. In addition, the eccentric cam 40 may be formed in a circular shape having an exterior diameter which corresponds with an interior diameter of the aperture of the small end 22, and may be concentrically inserted into the aperture of the small end 22. Further, the piston pin insertion aperture 12, into which the piston pin 12 is inserted, may be eccentrically formed at the eccentric cam 40. In other words, the piston 10 may be rotatably connected with the eccentric cam 40 as the piston pin 12 is inserted into the piston pin insertion apertures 12 formed at the piston 10 and the eccentric cam 40.

Thus, the eccentric cam 40 may be configured to rotate around a circle center thereof, and simultaneously, rotate around an axial center of the piston pin 12 which is arranged apart or at a distance from the circle center of the eccentric cam 40. Herein, as the piston pin 12 is eccentrically inserted into the eccentric cam 40, relative positions between the axial center of the piston pin 12 and a center of the aperture of the small end 22 may be changed based on rotation of the eccentric cam 40 in the aperture of the small end 22. In other words, as the eccentric cam 40 rotates in the aperture of the small end 22 to change a relative position of the piston 10 for the small end 22 of the connecting rod 20, a compression ratio of the mixture may be changed.

Further, the acting oil passages 25, 26, and 28 may be formed at the connecting rod 20, thereby supplying hydraulic pressure for selectively latching the eccentric cam 40 to the small end 22 of the connecting rod 20. In this regard, the eccentric cam 40 may be selectively latched to the small end 22 in one among at least two relative positions between the piston 10 and the connecting rod 20 small end 22 that are differently required based on a driving condition of an engine. In addition, the acting oil passages 25, 26, and 28 may be formed to receive hydraulic pressure from oil passages 35 which are formed at the crankshaft 30, the balance weight 32, and the crankpin 34. Herein, the oil passages 35 formed at the crankshaft 30, the balance weight 32, and the crankpin 34 and supply of hydraulic pressure therethrough are well known to a person of ordinary skill in the art, so detailed descriptions thereof will be omitted.

FIGS. 4 to 7 are operational views of a variable compression ratio apparatus according to an exemplary embodiment of the present invention. As shown in FIGS. 3 to 7, the variable compression ratio apparatus 1 according to an exemplary embodiment of the present invention may further include a first plate 42, a second plate 44, a fastening pin 46, and a latching pin 50, and the acting oil passages 25, 26, and 28 may include a first oil passage 25, a second oil passage 26, and a communicating passage 28.

The first plate 42 may be disposed to cover a first opened surface of the aperture of the small end 22 in which the eccentric cam 40 is inserted and seated. Meanwhile, the drawings illustrate that the first plate 42 is formed with a circular shape to have a diameter which is greater than a diameter of the eccentric cam 40, but it is not limited to a circular shape as long as the first plate 42 has a size that is capable of covering the aperture of the small end 22. In addition, the piston pin insertion aperture 12, through which the piston pin 12 is passed, may be formed at the first plate 42.

The second plate 44 may be disposed to cover a second opened surface of the aperture of the small end 22 in which the eccentric cam 40 is inserted and seated. Meanwhile, the drawings illustrate that the second plate 44 is formed in a circular shape to have a diameter which is greater than a diameter of the eccentric cam 40, but it is not limited thereto as long as the second plate 44 has a size that is capable of covering the aperture of the small end 22. In addition, the piston pin insertion aperture 12, through which the piston pin 12 is passed, may be formed at the second plate 44. In other words, the first plate 42 and the second plate 44 may be disposed at respective sides to prevent the eccentric cam 40 from escaping or being withdrawn from the small end 22, and the piston pin 12 may be inserted to sequentially penetrate a first side of the piston 10, the first plate 42, the eccentric cam 40, the second plate 44, and a second side of the piston 10.

The fastening pin 46 may fasten the first plate 42 and the second plate 44 to the eccentric cam 40. In addition, the fastening pin 46 may sequentially penetrate the first plate 42, the eccentric cam 40, and the second plate 44. Further, the first plate 42 and the second plate 44, which are fixed to the eccentric cam 40 by the fastening pin 46, may be configured to move together with the eccentric cam 40. In other words, the first plate 42 and the second plate 44 may be configured to rotate together with the eccentric cam 40. Therefore, the eccentric cam 40 may be latched to the small end 22 when one among the first plate 42 and the second plate 44 is latched to the small end 22 of the connecting rod 20.

Furthermore, the first oil passage 25 may be formed in a length direction of the connecting rod 20. In addition, the first oil passage 25 may extend from the larger end 24 to the small end 22 to latch the eccentric cam 40 with the small end 22 using hydraulic pressure supplied from the oil passages 35 formed at the crankshaft 30, the balance weight 32, and the crankpin 34. Meanwhile, hydraulic pressure used for latching the eccentric cam 40 with the small end 22 may be released via the oil passages 35 formed at the crankshaft 30, the balance weight 32, and the crankpin 34 and the first oil passage 25. Further, the first oil passage 25 may be disposed to be proximate to the first plate 42.

The second oil passage 26 may be formed in a length direction of the connecting rod 20. In addition, the second oil passage 26 may extend from the larger end 24 to the small end 22 to latch the eccentric cam 40 with the small end 22 using hydraulic pressure supplied from the oil passages 35 formed at the crankshaft 30, the balance weight 32, and the crankpin 34. In other words, the second oil passage 26 may be formed in parallel with the first oil passage 25. Meanwhile, hydraulic pressure used for latching the eccentric cam 40 with the small end 22 may be released via the oil passages 35 formed at the crankshaft 30, the balance weight 32, and the crankpin 34 and the second oil passage 26, and in this regard, hydraulic pressure that has been supplied through the first oil passage 25 may be released through the second oil passage 26 and hydraulic pressure that has been supplied through the second oil passage 26 may be released through the first oil passage 25. Further, the second oil passage 26 may be disposed to be proximate to the second plate 44.

The communicating passage 28 may be formed at the small end 22 to provide communication between the first oil passage 25 and the second oil passage 26. In other words, the communicating passage 28 may extend in parallel with a direction of the axis of rotation of the small end 22. In addition, both extended ends of the communicating passage 28 may be open. The latching pin may be is arranged in the communicating passage 28. In other words, the latching pin 50 may be disposed between the first plate 42 and the second plate 44. In addition, the latching pin 50 may be disposed to generate a reciprocal rectilinear motion in a direction for extending the communicating passage 28. Herein, the latching pin 50 may be moved in one direction by hydraulic pressure supplied through the first oil passage 25 and may be moved in an opposite direction by hydraulic pressure supplied through the second oil passage 26, thereby realizing a reciprocal rectilinear motion of the latching pin 50. In addition, the small end 22 may be latched with one among the first plate 42 and the second plate 44 as the latching pin 50 is moved by hydraulic pressure.

The variable compression ratio apparatus 1 according to an exemplary embodiment of the present invention may be configured so that the latching pin 50 forms a first land 51, a second land 52, and a spool shaft 53, and the communicating passage 28 forms a first chamber 25*c*, a second chamber 26*c*, and a communicating aperture 28*h*. The first land 51 may be formed at a first end of the latching pin 50 in a direction for generating a rectilinear motion, and an exterior surface of the first land 51 may face an interior surface of the first plate 42. For convenience of description, a direction in which the first plate 42 and the second plate 44 face the eccentric cam 40 will be defined as an "interior side", and a direction of opening the communicating passage 28 will be defined as an "exterior side". In addition, an exterior surface of the first land 51 and an interior surface the first plate 42 may be arranged almost without a gap in a state that either one among the first plate 42 and the second plate 44 is not latched with the small end 22.

The second land 52 may be formed at a second end of the latching pin 50 in a direction for generating a rectilinear motion, and an exterior surface thereof may face an interior surface of the second plate 44. In addition, an exterior surface of the second land 52 and an interior surface of the second plate 44 may be arranged almost without a gap in a state that either one among the first plate 42 and the second plate 44 is not latched with the small end 22. The spool shaft 53 may be formed to be thinner than the first land 51 and the second land 52, and may connect the first land 51 and the second land 52. Herein, diameters of the first land 51 and the second land 52 may be equal and a diameter of the spool shaft 53 may be less than diameters of the first land 51 and the second land 52 if an entire shape of the latching pin 50 is a cylindrical shape, and further, the first land 51, the second land 52, and the spool shaft 53 may be concentrically arranged.

The first chamber 25*c* is a space which may be in communication with the first oil passage 25. In addition, the first chamber 25*c* may be formed at a first end side (e.g., a first open end side) among both open ends of the communicating passage 28 to thus arrange the first land 51 therein. In other words, an exterior side of the first chamber 25*c* may be open. Further, the first chamber 25*c* may be formed to be longer than the first land 51 in a direction for generating a rectilinear motion of the latching pin 50, and may have a size to correspond with the first land 51 in a direction which is vertically arranged with a direction for generating a rectilinear motion of the latching pin 50. In other words, if an entire shape of the latching pin 50 is a cylindrical shape, an interior diameter of the first chamber 25*c* corresponds with an exterior diameter of the first land 51.

The second chamber 26*c* is a space which may be in communication with the second oil passage 26. In addition, the second chamber 26*c* may be formed at a second end side (e.g., a second open end side) among both open ends of the communicating passage 28 to thus arrange the second land 52 therein. In other words, an exterior side of the second chamber 26*c* may be open. Further, the second chamber 26*c* may be formed to be longer than the second land 52 in a direction for generating a rectilinear motion of the latching pin 50, and may have a size to correspond with the second land 52 in a direction which is vertically arranged with a direction for generating a rectilinear motion of the latching pin 50. In other words, if an entire shape of the latching pin 50 is a cylindrical shape, an interior diameter of the second chamber 26*c* corresponds with an exterior diameter of the second land 52.

The communicating aperture 28*h* may provide communication between the first chamber 25*c* and the second chamber 26*c* such that the spool shaft 53 may be arranged therein. In addition, the communicating aperture 28*h* may have a size to correspond with the spool shaft 53 in a direction which is vertically arranged with a direction for generating a rectilinear motion of the latching pin 50. In other words, an interior diameter of the first chamber 25*c* may be equal to an interior diameter of the second chamber 26*c* and an interior diameter of the communicating aperture 28*h* may be less than interior diameters of the first chamber 25*c* and the second chamber 26*c* and corresponds with an exterior diameter of the spool shaft 53 if entire shapes of the latching pin 50 and the communicating passage 28 are a cylindrical shape, and further, the first chamber 25*c*, the second chamber 26*c*, and the communicating aperture 28*h* may be concentrically arranged. Therefore, the first land 51 or the second land 52 functions as a stopper to prevent excessive motion of the latching pin 50 by being blocked to a step between the communicating aperture 28*h* and the first chamber 25*c* or the second chamber 26*c* when the latching pin 50 generates a rectilinear motion. Particularly, contact of the first land 51 or the second land 52 with the first plate 42 or the second plate 44 by a motion of the latching pin 50 may be prevented.

Figure 4:
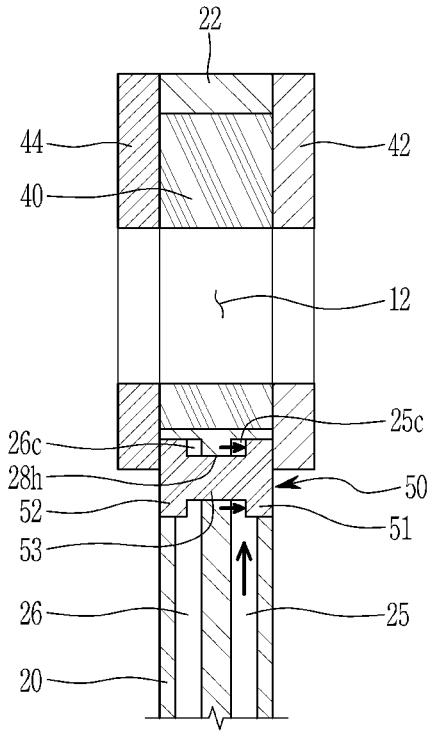
FIGS. 4 to 7 are operational views of a variable compression ratio apparatus according to an exemplary embodiment of the present invention.

Hereinafter, an operation of the variable compression ratio apparatus 1 according to an exemplary embodiment of the present invention will be described referring to FIGS. 4 to 7. As shown in FIG. 4, in the variable compression ratio apparatus 1 according to an exemplary embodiment of the present invention, a force for moving the latching pin 50 toward the first plate 42 may be generated as hydraulic pressure transferred between an interior surface of the first land 51 of the first chamber 25*c* and the communicating aperture 28*h* pushes an interior surface of the first land 51 when hydraulic pressure transferring through the first oil passage 25 is supplied to the first chamber 25*c*.

Figure 5:
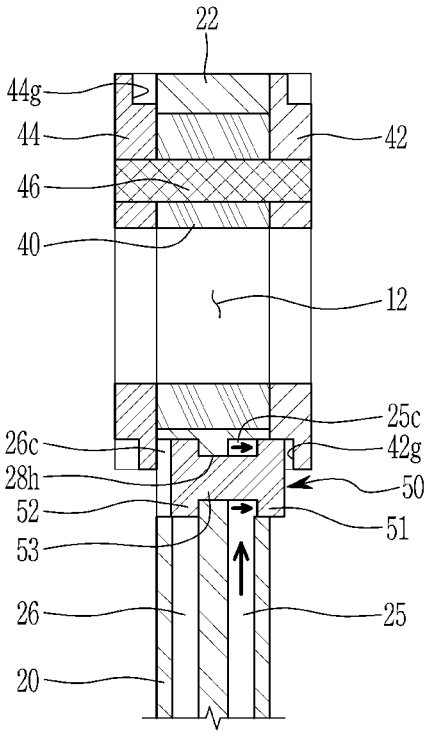

As shown in FIG. 5, while maintaining the force for moving the latching pin 50 toward the first plate 42, the latching pin 50 may be moved such that the first land 51 is inserted into a first latching groove 42*g* when the first latching groove 42*g* recessed from an interior surface of the first plate 42 is positioned to be corresponded with the first chamber 25*c* depending on rotation of the eccentric cam 40, the first plate 42, and the second plate 44. Herein, the first latching groove 42*g* may be formed in a shape that corresponds with parts of the first chamber 25*c* and the first land 51. For instance, if the first chamber 25*c* and the first land 51 are formed in a circular shape, the first latching groove 42*g* may be formed in a semicircular shape and the first land 51 may be inserted as a semicircle. In this regard, the small end 22 may be latched to the eccentric cam 40 when the latching pin 50 is moved to be inserted into the first latching groove 42*g*.

Figure 6:
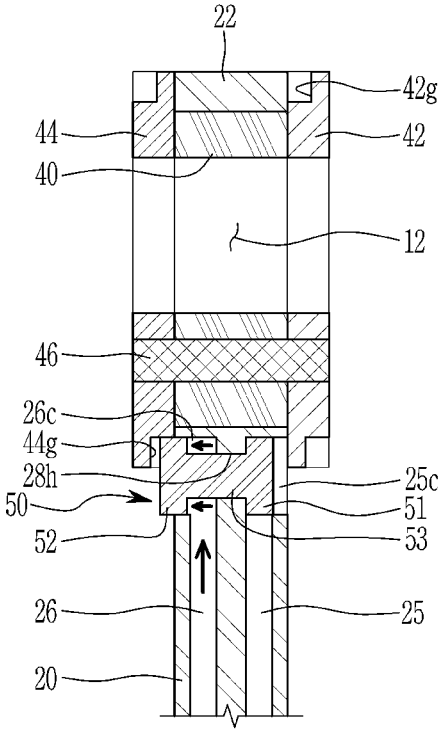

As shown in FIG. 6, in the variable compression ratio apparatus 1 according to an exemplary embodiment of the present invention, a force for moving the latching pin 50 toward the second plate 44 may be generated as hydraulic pressure transferred between an interior surface of the second land 52 of the second chamber 26*c* and the communicating aperture 28*h* pushes an interior surface of the second land 52 when hydraulic pressure transferring through the second oil passage 26 is supplied to the second chamber 26*c*, and the latching pin 50 may be moved to insert the second land 52 into a second latching groove 44*g* when the second latching groove 44*g* that is recessed from an interior surface of the second plate 44 is positioned to correspond with the second chamber 26*c* depending on rotation of the eccentric cam 40, the first plate 42, and the second plate 44 while maintaining the force for moving the latching pin 50 toward the second plate 44.

Herein, the second latching groove 44*g* may be formed in a shape that corresponds with parts of the second chamber 26*c* and the second land 52. For instance, if the second chamber 26*c* and the second land 52 are formed in a circular shape, the second latching groove 44*g* may be formed in a semicircular shape and the second land 52 may be inserted as a semicircle. In this regard, the small end 22 may be latched to the eccentric cam 40 when the latching pin 50 is moved to be inserted into the second latching groove 44*g*.

The drawings illustrate that a low compression ratio condition of an engine is achieved as a distance between the piston pin 12 and the crankpin 34 is relatively near, that is, the piston 10 may be positioned to be relatively low when the latching pin 50 is inserted into the first latching groove 42*g* to latch the small end 22 to the eccentric cam 40. A high compression ratio condition of an engine is achieved as a distance between the piston pin 12 and the crankpin 34 is relatively far, that is, the piston 10 is positioned to be relatively high when the latching pin 50 is inserted into the second latching groove 44*g* to latch the small end 22 to the eccentric cam 40. Herein, a low compression ratio and a high compression ratio of an engine may be determined based on the positions for forming the first latching groove 42*g* and the second latching groove 44*g*.

Meanwhile, if the first plate 42 and the second plate 44 are formed in circular shapes which are concentrically arranged with the eccentric cam 40, and the first latching groove 42*g* and the second latching groove 44*g* are formed with a 180 degree gap in a circumference direction of the eccentric cam 40, a load of a torque being transferred to the eccentric cam 40 when latching may be minimized. Further, if the first plate 42 and the second plate 44 do not have circular shapes, mass may be decreased in comparison with forming the first plate 42 and the second plate 44 with circular shapes. Particularly, mass may be further decreased when the first latching groove 42*g* and the second latching groove 44*g* are formed with a gap that is less than 180 degrees in a circumference direction of the eccentric cam 40.

Figure 7:
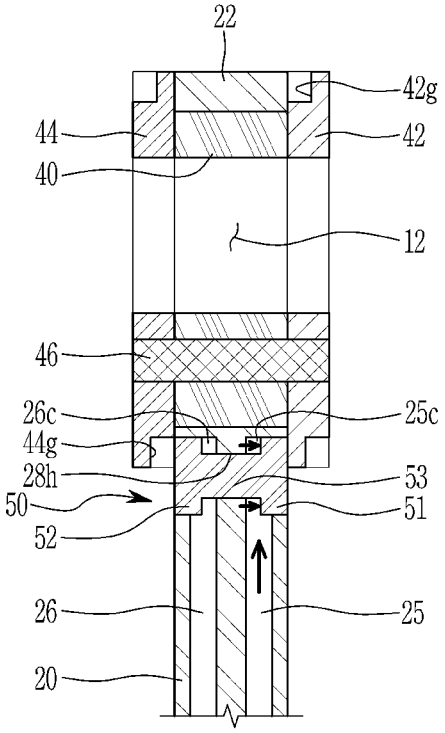

As shown in FIG. 7, an operation of returning the latching pin 50 to the state that either one among the first plate 42 and the second plate 44 is not latched with the small end 22 may be performed as hydraulic pressure is supplied through the second oil passage 26 in the state that the latching pin 50 is inserted into the first latching groove 42*g* and hydraulic pressure may be supplied through the first oil passage 25 in the state that the latching pin 50 is inserted into the second latching groove 44*g*. In other words, the latching pin 50 is to be far from the first latching groove 42*g* to be returned to an original position as hydraulic pressure being transferred in the second chamber 26*c* pushes an interior surface of the second land 52 when the latching pin 50 is inserted into the first latching groove 42*g*, and the latching pin 50 is to be far from the second latching groove 44*g* to be returned to an original position as hydraulic pressure being transferred in the first chamber 25*c* pushes an interior surface of the first land 51 when the latching pin 50 is inserted into the second latching groove 44*g*.

Figure 8:
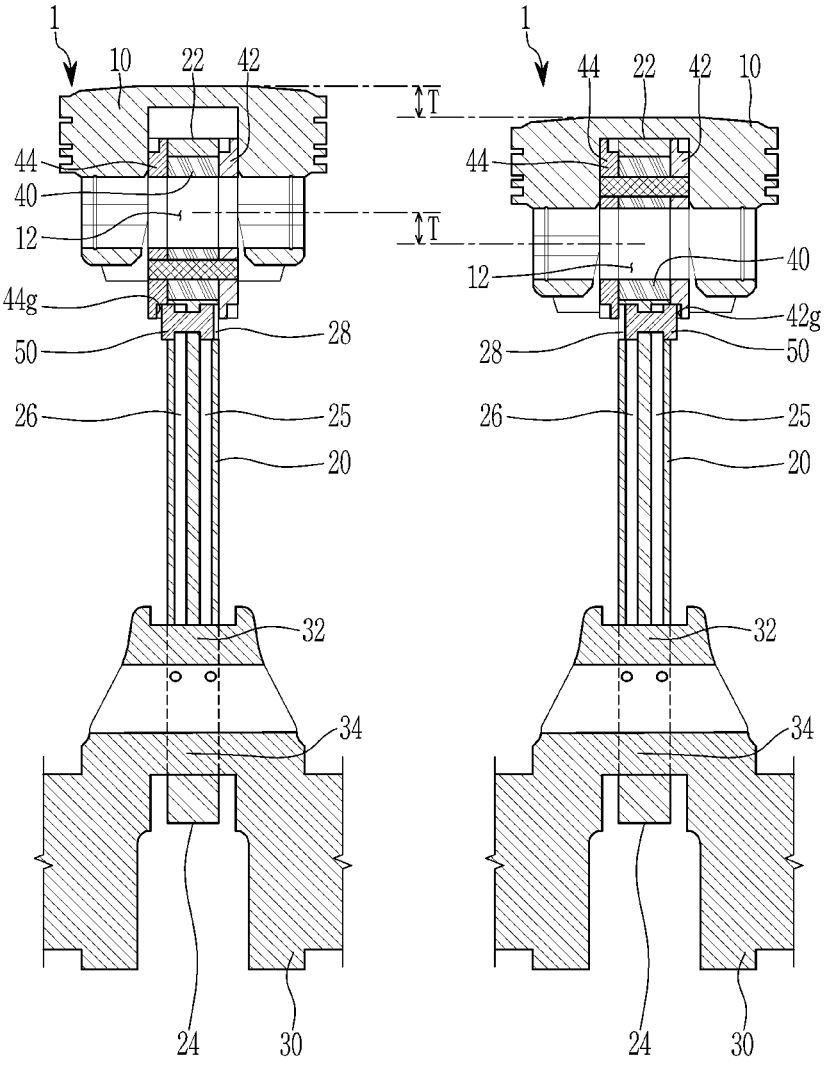
FIG. 8 is a schematic diagram for comparing a position in a low compression ratio with a position in a high compression ratio of a piston according to an exemplary embodiment of the present invention.

FIG. 8 is a schematic diagram for comparing a position in a low compression ratio with a position in a high compression ratio of a piston according to an exemplary embodiment of the present invention. As shown in FIG. 8, top dead center of the piston 10 when an engine is driven at a low compression ratio as the latching pin 50 is inserted into the first latching groove 42*g* and top dead center of the piston 10 when an engine is driven at a high compression ratio as the latching pin 50 is inserted into the second latching groove 44*g* may be different from each other as a predetermined value T. In FIG. 8, the difference value T between top dead center of the piston 10 when an engine is driven at a low compression ratio and top dead center of the piston 10 when an engine is driven at a high compression ratio is illustrated as a difference between lines that extend from an axial center of the piston pin insertion aperture 12 in each condition.

According to an exemplary embodiment of the present invention, manageability of control may be improved as a composition for limiting rotation of the eccentric cam 40 is simplified. In addition, Interference by rotational inertia in latching the eccentric cam 40 may be prevented and cost may be reduced as the latching pin 50 adapted to have a simplified composition and moved in a direction which is arranged in parallel with the crankshaft 30 is provided. Further, operational reliability may be improved as the acting oil passages 25, 26, and 28 for the latching pin 50 are simplified.

While this invention has been described in connection with what is presently considered to be exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. A variable compression ratio (VCR) apparatus installed within an engine that rotates a crankshaft upon receiving combustion power of a fuel mixture from a piston and changes a compression ratio of the mixture based on a driving condition of the engine, the VCR apparatus comprising:

a connecting rod at which a small end forming an aperture having a circular shape to be rotatably connected with a piston pin moving together with the piston, a larger end rotatably connected with a crankpin eccentrically arranged with respect to the crankshaft, an acting oil passage formed such that hydraulic pressure is supplied from the second end larger end to the small end;

an eccentric cam concentrically arranged and rotatably disposed in the aperture of the small end and the piston pin is eccentrically inserted thereinto and is rotatably connected therewith;

a latching pin disposed in the small end to generate a reciprocal rectilinear motion in a direction of an axis of rotation of the small end and operated to selectively latch the small end with the eccentric cam in one among at least two relative positions between the small end and the eccentric cam by hydraulic pressure being supplied to the small end through the acting oil passage;

a first plate disposed to cover a first opened surface of the small end, in which the eccentric cam is inserted and seated, to move together with the eccentric cam and the piston pin is rotatably connected thereto and the latching pin for latching the small end with the eccentric cam is selectively inserted thereinto; and a second plate disposed to cover a second opened surface of the small end, in which the eccentric cam is inserted and seated, to move together with the eccentric cam and the piston pin is rotatably connected thereto and the latching pin for latching the small end with the eccentric cam is selectively inserted thereinto.

2. The VCR apparatus of claim 1, wherein the acting oil passage includes:

a first oil passage that extends from the larger end to the small end in a length direction of the connecting rod to receive hydraulic pressure transferred through the crankshaft and disposed to be proximate to the first plate;

a second oil passage that extends from the larger end to the small end in a length direction of the connecting rod to receive hydraulic pressure transferred through the crankshaft and disposed to be proximate to the second plate; and a communicating passage that extends in a direction of the axis of rotation in the small end to communicate the first oil passage with the second oil passage and the latching pin is disposed therein to move toward the first plate by hydraulic pressure supplied through the first oil passage and move toward the second plate by hydraulic pressure supplied through the second oil passage.

3. The VCR apparatus of claim 2, wherein the latching pin forms:

a first land at a first end of the latching pin in a direction for generating a rectilinear motion and an exterior surface thereof faces an interior surface of the first plate;

a second land at a second end of the latching pin in a direction of generating a rectilinear motion and an exterior surface thereof faces an interior surface of the second plate; and a spool shaft to be thinner than the first land and the second land and configured to connect the first land and the second land.

4. The VCR apparatus of claim 3, wherein the communicating passage forms:

a first chamber that communicates with the first oil passage, formed to be longer than the first land in a direction for generating a rectilinear motion of the latching pin and to have a size corresponding with the first land in a direction which is vertically arranged in a direction for generating a rectilinear motion of the latching pin at a first end side of the communicating passage to dispose the first land therein, and an exterior side thereof is open;

a second chamber that communicates with the second oil passage, formed to be longer than the second land in a direction for generating a rectilinear motion of the latching pin and to have a size corresponding with the second land in a direction which is vertically arranged with a direction for generating a rectilinear motion of the latching pin at a second end side of the communicating passage to dispose the second land therein, and an exterior side thereof is open; and a communicating aperture that provides communication between the first chamber and the second chamber to dispose the spool shaft therein and being formed to have a size corresponding with the spool shaft in a direction which is vertically arranged with a direction for generating a rectilinear motion of the latching pin.

5. The VCR apparatus of claim 4, wherein a force for moving the latching pin toward the first plate is generated as hydraulic pressure being transferred between an interior surface of the first land and the communicating aperture in the first chamber pushes an interior surface of the first land when hydraulic pressure transferring through the first oil passage is supplied to the first chamber.

6. The VCR apparatus of claim 5, wherein the latching pin is moved to insert the first land into a first latching groove when the first latching groove that is recessed from an interior surface of the first plate is positioned to correspond with the first chamber based on rotation of the eccentric cam while maintaining the force for moving the latching pin toward the first plate.

7. The VCR apparatus of claim 6, wherein a low compression ratio condition of an engine is achieved as top dead center of the piston is relatively low when the small end is latched to the eccentric cam by inserting the first land into the first latching groove.

8. The VCR apparatus of claim 7, wherein an operation of returning the latching pin into a state that the small end is not latched to the eccentric cam is performed as hydraulic pressure transferred between an interior surface of the second land of the second chamber and the communicating aperture via the second oil passage pushes an interior surface of the second land in a state that the first land is inserted into the first latching groove.

9. The VCR apparatus of claim 4, wherein a force for moving the latching pin toward the second plate is generated as hydraulic pressure being transferred between an interior surface of the second land and the communicating aperture in the second chamber pushes an interior surface of the second land when hydraulic pressure transferring through the second oil passage is supplied to the second chamber.

10. The VCR apparatus of claim 9, wherein the latching pin is moved to insert the second land into the second latching groove when the second latching groove that is recessed from an interior surface of the second plate is positioned to correspond with the second chamber based on rotation of the eccentric cam while maintaining the force for moving the latching pin toward the second plate.

11. The VCR apparatus of claim 10, wherein a high compression ratio condition of an engine is achieved as top dead center of the piston is relatively high when the small end is latched to the eccentric cam by inserting the second land into the second latching groove.

12. The VCR apparatus of claim 11, wherein an operation of returning the latching pin into a state that the small end is not latched to the eccentric cam is performed as hydraulic pressure transferred between an interior surface of the first chamber and the communicating aperture via the first oil passage pushes an interior surface of the first land in a state that the second land is inserted into the second latching groove.

13. The VCR apparatus of claim 4, wherein either one among a low compression ratio condition of an engine by a relatively low top dead center of the piston and a high compression ratio condition of an engine by a relatively high top dead center of the piston is achieved when the first land is inserted into a first latching groove that is recessed from an interior surface of the first plate based on rotation of the eccentric cam while maintaining a force to push an interior surface of the first land due to hydraulic pressure transferred between an interior surface of the first land and the communicating aperture in the first chamber via the first oil passage, and the other one among a low compression ratio condition of an engine by a relatively low top dead center of the piston and a high compression ratio condition of an engine by a relatively high top dead center of the piston is achieved when the second land is inserted into a second latching groove that is recessed from an interior surface of the second plate based on rotation of the eccentric cam while maintaining a force to push an interior surface of the second land due to hydraulic pressure transferred between an interior surface of the second land and the communicating aperture in the second chamber via the second oil passage.

* * * * *